US008651591B1

(12) United States Patent
Chen et al.

(10) Patent No.: US 8,651,591 B1
(45) Date of Patent: Feb. 18, 2014

(54) LOCK DEVICE FOR TWO WAY TRAVEL DRAWER

(71) Applicants: Kung-Cheng Chen, Taichung (TW); Lung-Chuan Huang, Taichung (TW)

(72) Inventors: Kung-Cheng Chen, Taichung (TW); Lung-Chuan Huang, Taichung (TW)

(73) Assignee: E-MAKE Co., Ltd., Taichung (TW)

( * ) Notice: Subject to any disclaimer, the term of this patent is extended or adjusted under 35 U.S.C. 154(b) by 0 days.

(21) Appl. No.: 13/732,035

(22) Filed: Dec. 31, 2012

(51) Int. Cl.
*E05B 53/00* (2006.01)

(52) U.S. Cl.
USPC ..... 312/218

(58) Field of Classification Search
USPC ..... 312/215, 216, 217, 218, 219, 220, 222; 292/137, 138, 340, DIG. 40, DIG. 18
See application file for complete search history.

(56) References Cited

U.S. PATENT DOCUMENTS

| | | | | | |
|---|---|---|---|---|---|
| 2,565,784 | A | * | 8/1951 | Sheean | 312/286 |
| 2,646,333 | A | * | 7/1953 | Grube et al. | 312/334.16 |
| 2,716,046 | A | * | 8/1955 | Minturn | 312/286 |
| 2,914,370 | A | * | 11/1959 | Hensch et al. | 312/286 |
| 3,323,849 | A | * | 6/1967 | Stark | 312/221 |
| 3,404,929 | A | * | 10/1968 | Wright et al. | 312/216 |
| 3,767,280 | A | * | 10/1973 | McLaughlin | 312/219 |
| 3,909,090 | A | * | 9/1975 | Breckner et al. | 312/217 |
| 4,002,385 | A | * | 1/1977 | Hone | 312/286 |
| 4,183,596 | A | * | 1/1980 | Greene et al. | 312/333 |
| 4,429,930 | A | * | 2/1984 | Blouin | 312/216 |
| 4,480,883 | A | * | 11/1984 | Young | 312/220 |
| 4,768,844 | A | * | 9/1988 | Ludwig | 312/221 |
| 4,889,396 | A | * | 12/1989 | Mitchell et al. | 312/221 |
| 4,936,640 | A | * | 6/1990 | Pratzer | 312/221 |
| 4,957,334 | A | * | 9/1990 | Lakso | 312/221 |
| 4,966,423 | A | * | 10/1990 | Higuera et al. | 312/221 |
| 5,056,877 | A | * | 10/1991 | Westwinkel | 312/221 |
| 5,074,627 | A | * | 12/1991 | Broeders | 312/221 |
| 5,176,436 | A | * | 1/1993 | Mitchell | 312/221 |
| 5,199,774 | A | * | 4/1993 | Hedinger et al. | 312/219 |
| 5,303,994 | A | * | 4/1994 | Elsholz | 312/221 |
| 5,335,986 | A | * | 8/1994 | Hartrum et al. | 312/220 |
| 5,599,078 | A | * | 2/1997 | Dechene et al. | 312/221 |
| 5,634,701 | A | * | 6/1997 | Hendrich et al. | 312/221 |
| 5,671,985 | A | * | 9/1997 | Grieser et al. | 312/221 |
| 5,702,167 | A | * | 12/1997 | Muller | 312/221 |
| 5,772,294 | A | * | 6/1998 | Hendrich et al. | 312/221 |
| 5,829,859 | A | * | 11/1998 | Cram | 312/221 |
| 5,855,423 | A | * | 1/1999 | Cram | 312/221 |
| 5,931,548 | A | * | 8/1999 | Bischoff | 312/221 |
| 5,997,114 | A | * | 12/1999 | Bischoff | 312/215 |
| 6,082,839 | A | * | 7/2000 | Chiku | 312/219 |
| 6,742,854 | B2 | * | 6/2004 | Chen | 312/217 |
| 6,896,342 | B1 | * | 5/2005 | Cheng | 312/221 |

(Continued)

*Primary Examiner* — Darnell Jayne
*Assistant Examiner* — Kimberley S Wright

(57) ABSTRACT

A lock device for two-way travel drawers of a support body is provided with in combination a peg on a central portion of one side of the drawer; two two-way travel slides each on an outer surface of either side of the drawer; and a lock assembly including a groove member, a sliding member, a lock, and snapping members. The groove member has a rectangular section and includes front and rear flanges to be secured to a wall of the support body. The sliding member has a rectangular section, is slidably disposed in the groove member, and includes openings. The lock is disposed on an upper portion of the wall of the support body and capable of actuating to activate the sliding member. The snapping members are retained in the openings and capable of locking or unlocking the peg when the sliding member moves.

2 Claims, 10 Drawing Sheets

(56) References Cited

U.S. PATENT DOCUMENTS

| | | | | |
|---|---|---|---|---|
| 7,140,700 | B2 * | 11/2006 | Dube et al. | 312/221 |
| 7,823,992 | B2 * | 11/2010 | Chen et al. | 312/221 |
| 8,297,723 | B2 * | 10/2012 | Chen et al. | 312/333 |
| 8,511,765 | B1 * | 8/2013 | Chen et al. | 312/333 |
| 2003/0025425 | A1 * | 2/2003 | Cheng | 312/218 |
| 2004/0051425 | A1 * | 3/2004 | Chen | 312/217 |
| 2007/0035218 | A1 * | 2/2007 | Chen et al. | 312/221 |
| 2008/0106175 | A1 * | 5/2008 | Huang | 312/217 |
| 2009/0160298 | A1 * | 6/2009 | Chen et al. | 312/333 |

* cited by examiner

LOCK DEVICE FOR TWO WAY TRAVEL DRAWER

BACKGROUND OF THE INVENTION

1. Field of the Invention

The invention relates to drawer slides and more particularly to a lock device for a two-way travel drawer.

2. Description of Related Art

A drawer is a box shaped container that fits into a piece of furniture in such a way that it can be drawn out horizontally to access its contents. However, typical drawers are designed to open or close from a front end of the drawer but not from either the front end or the rear end of the drawer.

A conventional two-way travel three section slide drawer slide assembly for permitting a drawer to be selectively pulled out from opposite open ends of a compartment of a cabinet, comprises in combination an elongated outer section comprising a flat track threadedly secured to the compartment, and two sets of two projecting stop elements wherein the stop elements of either set are opposite and formed on one of two lengthwise curved edges of the track of the outer section; an elongated intermediate section disposed in the outer section and comprising a flat track, two engaging members at both ends respectively, and two sets of two projecting stop members wherein one set of stop members is proximate to the engaging members at one end, and the other set of stop members is proximate to the engaging members at the other end; two elongated sliding members each slidably disposed either between upper edges of the outer section and the intermediate section or between lower edges of the outer section and the intermediate section wherein each sliding member is limited to travel in a distance between the stop members of one set and the stop members of the other set; an elongated inner section releasably secured to the drawer and comprising a two-end open flat track, an intermediate opening, two positioning members at both ends of the intermediate opening respectively, and two lanced out tabs each spaced from the positioning member; an elongated bearing member disposed between the intermediate section and the inner section; two stop units releasably secured to the engaging members respectively, each stop unit comprising two bent projections on upper and lower edges respectively, two flanges extending from the upper and lower edges respectively but opposing the adjacent projection, each flange including an inclined first surface at one end and an inclined second surface at the other end, and two horizontal sliding members each extending from one edge of the adjacent projection, each sliding member including a cavity at one end; and a flexible limit member comprising an intermediate flat portion adjacent to the intermediate opening, the limiting member further comprising, on either end of the flat portion, a latching member including an inclined surface at one end and an inclined extension at an intermediate portion, a ramp formed on the latching member, a slot abutted on the ramp, and a rectangular cut formed at the other end of the latching member distal the slot.

However, the conventional drawers tend to malfunction. Furthermore, its components are complicated.

Thus, the need for providing a drawer having two slide assemblies for allowing the drawer to selectively draw out or pull back from one of two opposite directions of a support body (e.g., desk, cabinet, or the like) still exists.

SUMMARY OF THE INVENTION

It is therefore one object of the invention to provide a lock device for a plurality of two-way travel drawers of a support body, comprising in combination a peg disposed on a central portion of one side of the two-way travel drawer; two two-way travel slides each disposed on an outer surface of either side of the two-way travel drawer; and a lock assembly comprising a groove member, a sliding member, a lock, and a plurality of snapping members wherein the groove member has a rectangular section and includes front and rear flanges to be secured to a wall of the support body; the sliding member has a rectangular section, is slidably disposed in the groove member, and includes a plurality of rectangular openings arranged longitudinally; the lock is disposed on an upper portion of the wall of the support body and capable of actuating to activate the sliding member; and the snapping members are retained in the rectangular openings and capable of locking or unlocking the peg when the sliding member moves.

The above and other objects, features and advantages of the invention will become apparent from the following detailed description taken with the accompanying drawings.

DETAILED DESCRIPTION OF THE INVENTION

Figure 1:
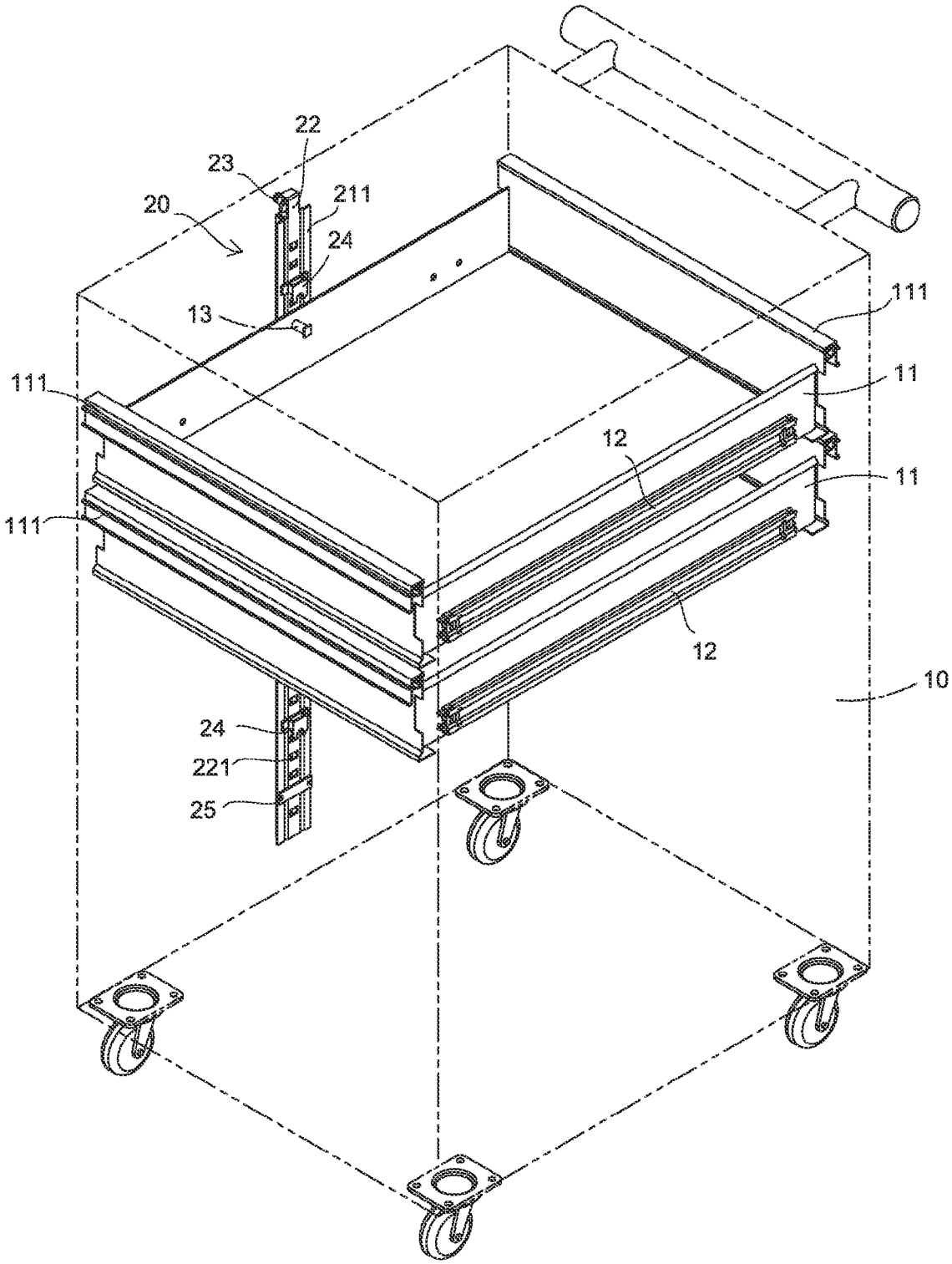
FIG. 1 is a perspective view of a cart having a plurality of two-way travel drawers incorporating a lock device according to a first preferred embodiment of the invention.
Figure 2:
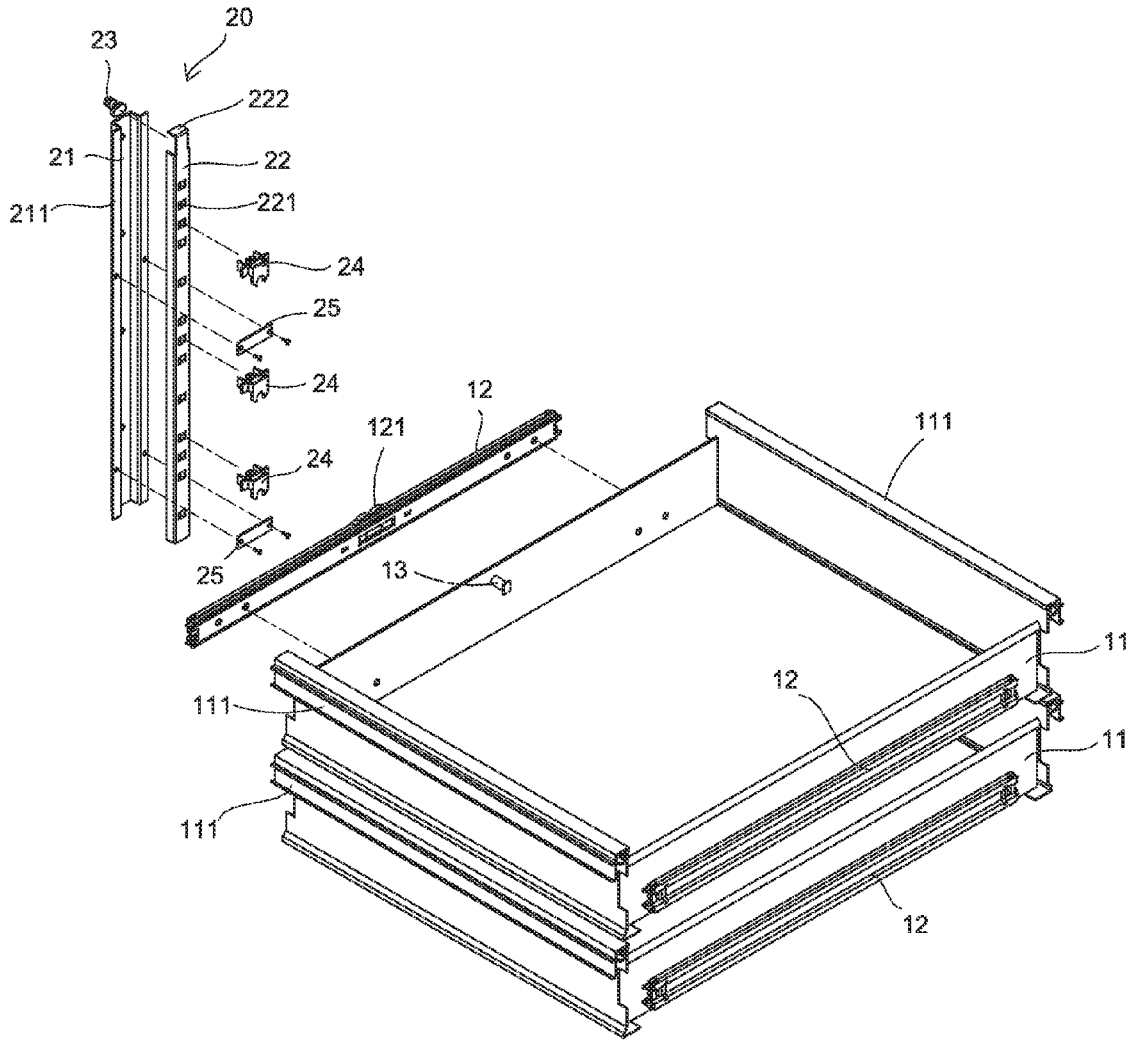
FIG. 2 is an exploded view of the lock device with the associated slide detached from the drawer side.
Figure 3:
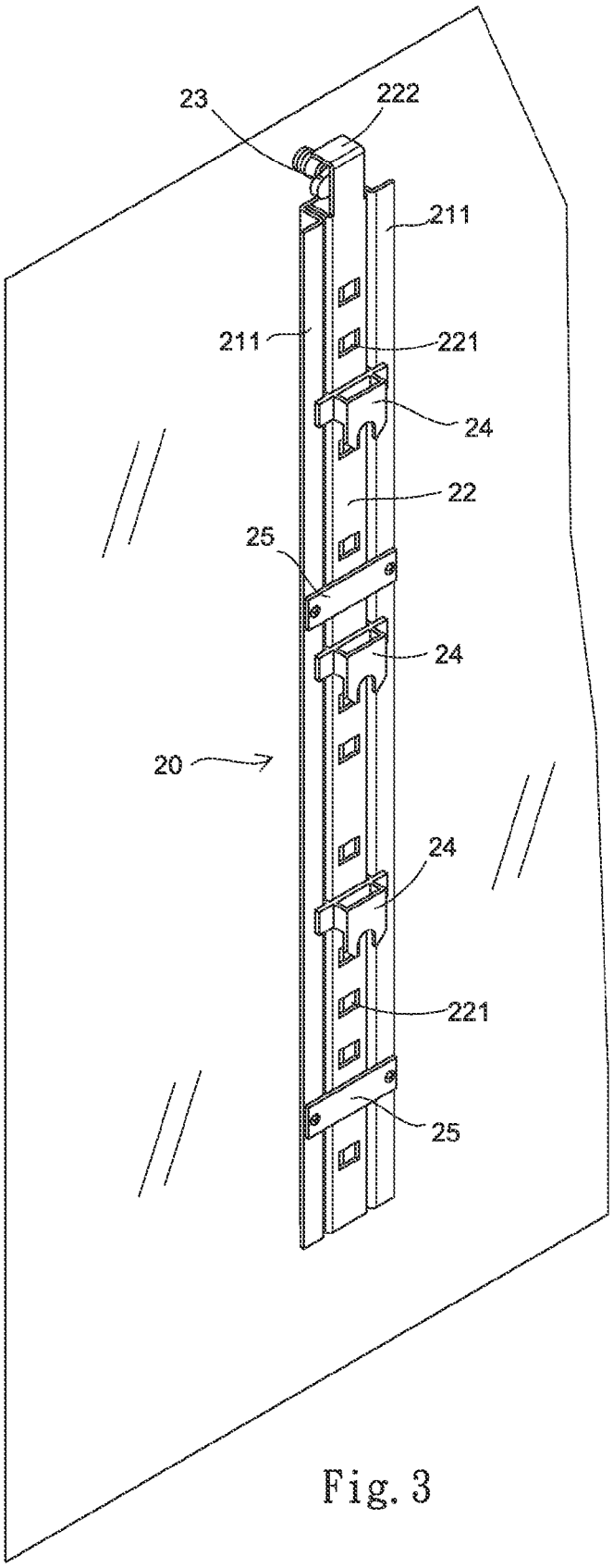
FIG. 3 is a perspective view of the assembled lock device.
Figure 4:
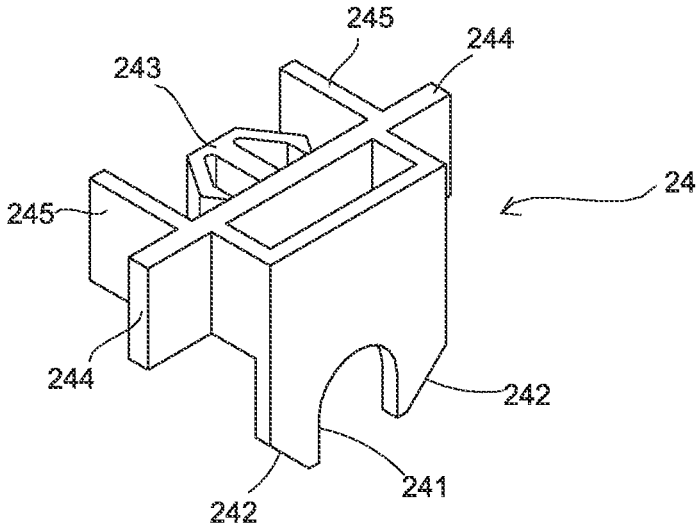
FIG. 4 is a perspective view of the snapping member.
Figure 5:
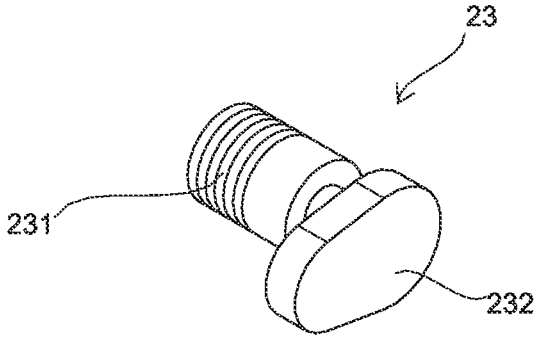
FIG. 5 is a perspective view of the lock.

Referring to FIGS. 1 to 9, a lock device for a two-way travel drawer in accordance with a first preferred embodiment of the invention is shown and comprises the following components.

A cart 10 is a hollow structure having a plurality of drawers 11 disposed vertically. A peg 13 is provided on a central portion of one side of each drawer 11. A slide (e.g., two-way travel slide) 12 is lengthwise provided on an outer surface of each side of the drawer 11. A wave shaped positioning seat 121 projects upward from a central portion of a top of the slide 12 for holding the peg 13 in place when the peg 13 is rested on the positioning seat 121. The drawer 11 has a handle 111 on a top edge of each of front and rear ends.

A lock assembly 20 is longitudinally mounted on one side of the cart 10 and comprises a longitudinal groove member 21, a sliding member 22, a lock 23, and a plurality of snapping members 24.

The groove member 21 has a rectangular section and comprises front and rear flanges 211. The sliding member 22 has a section of rectangle and is shaped to slidably dispose in the groove member 21. A plurality of rectangular plates 25 are threadedly secured to the flanges 211 to hold the sliding member 22 in the groove member 21. The sliding member 22 comprises a plurality of rectangular openings 221 arranged longitudinally and a bent stop member 222 on a top.

The lock 23 comprises a threaded shank 231 at on end mounted in the wall of the cart 10 and a cam 232 at the other end engaging a bottom of the stop member 222. A key (not shown) can be inserted into the shank 231 to rotate the cam 232 which in turn moves the stop member 222 (i.e., the sliding member 22) upward or downward.

The snapping member 24 comprises a latch 243, a trough 241 distal the latch 243, two inclined surfaces 242 on front and rear ends of the trough 241 respectively, a first wall 244, and two second walls 245 with the latch 243 disposed therebetween, the second walls 245 being perpendicular to the first wall 244. The latch 243 is retained in the opening 221 (see FIG. 8). The peg 13 is partially disposed in the trough 241 and supported by the positioning seat 121. The first wall 244 is slidably engaged with the flanges 221. Each of the second walls 245 is slidably disposed between the sliding member 22 and front (or rear) edge of the groove member 21. It is envisaged by the invention that the snapping member 24 can be disposed in any opening 221 depending on height of the drawer 11 so that the drawers 11 can be replaced easily.

Figure 6:
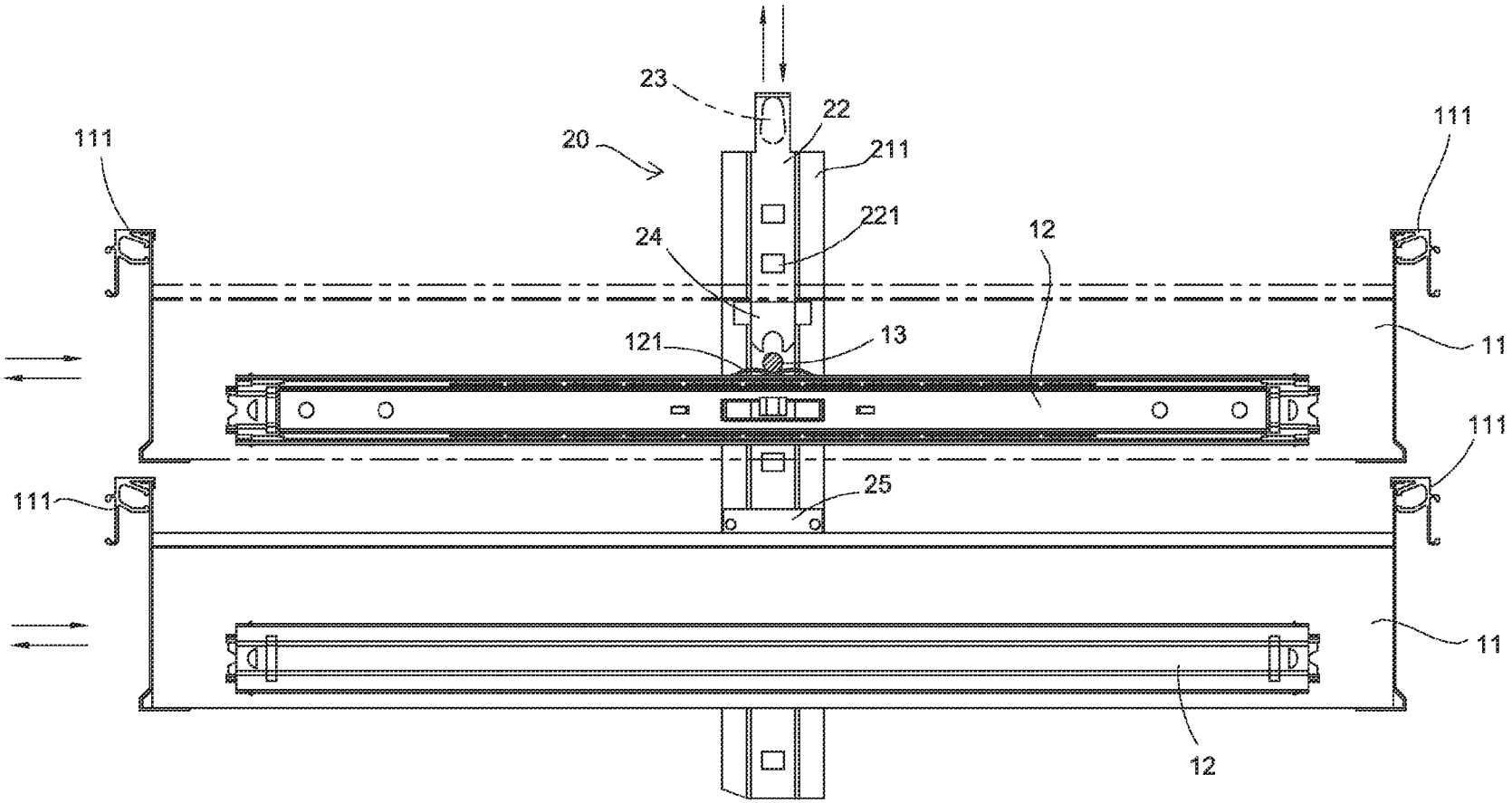
FIG. 6 is a side elevation showing the drawer being unlocked.
Figure 7:
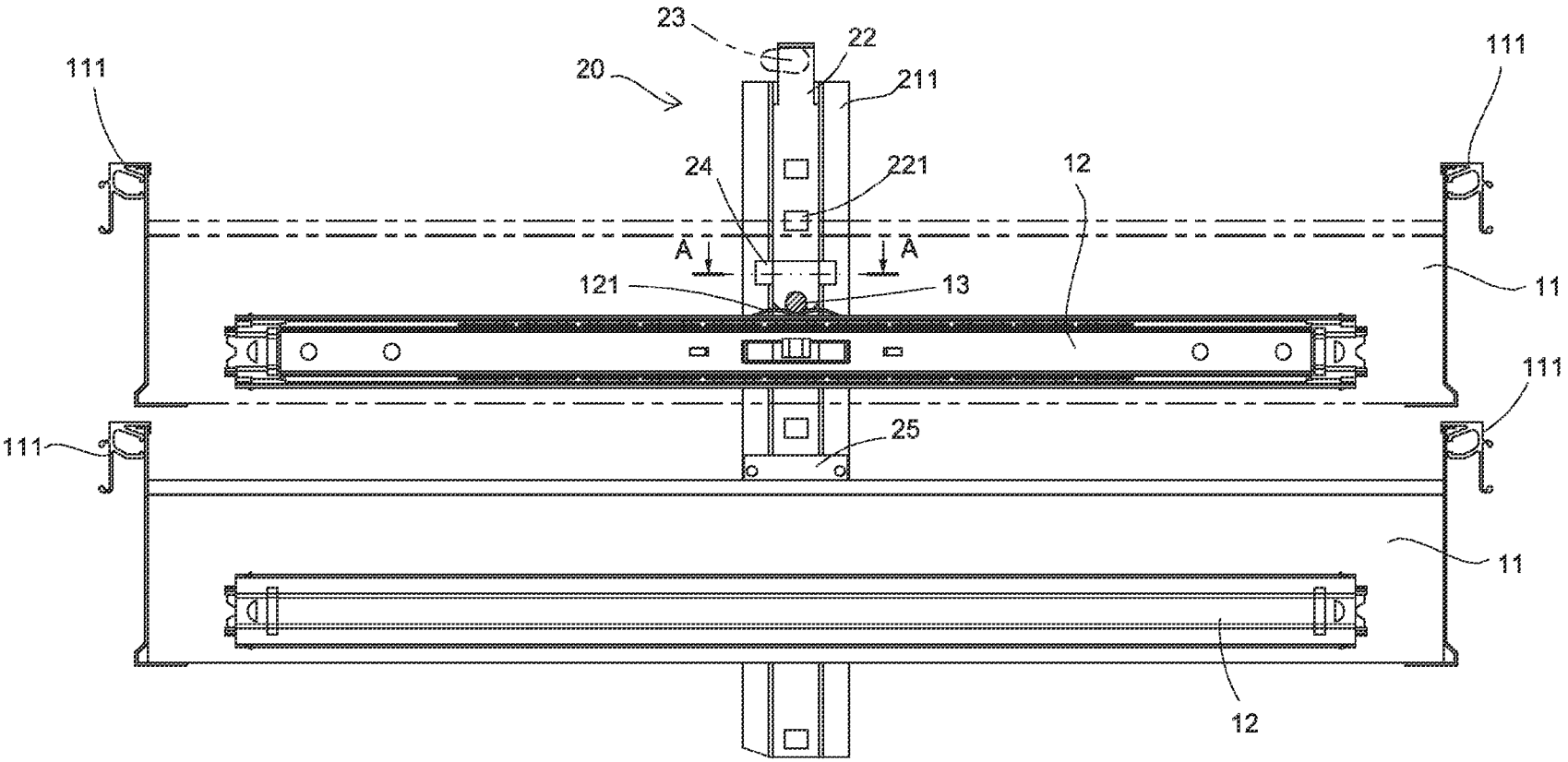
FIG. 7 is a view similar to FIG. 6 showing the drawer being locked by the snapping member by turning the lock of the lock device.
Figure 8:
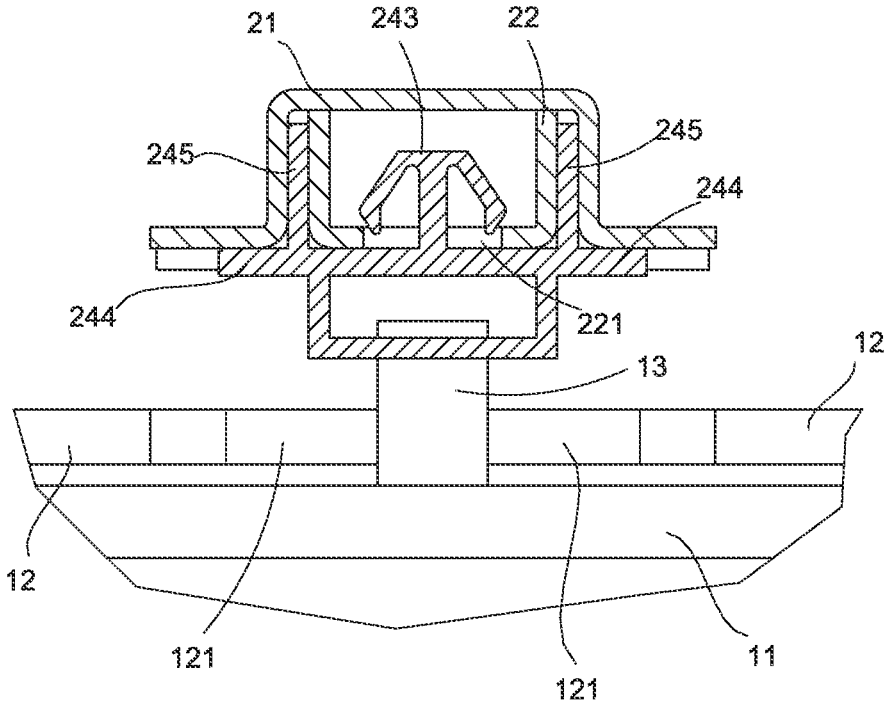
FIG. 8 is a sectional view showing the snapping member disposed onto the sliding member in the groove member.

Locking and unlocking operations of the invention are detailed below. As shown in FIG. 6, the sliding member 22 is pushed upward by the lock 23 to unlock the drawer 11. Thus, the drawer 11 can be push forward or rearward along the slides 12. For locking the drawer 11, a user may push or pull the drawer 11 in the locked position with the peg 13 being disposed on the positioning seat 121 (i.e., clearing the trough 241). The drawer 11 is thus stably disposed. Next, the user may insert a key into the lock 23 to clockwise rotate the threaded shank 231 about 90 degrees and thus rotate the cam 232 the same angle (see FIG. 7). Thus, the trough 241 falls to clamp the peg 13 so as to lock the drawer 11.

Figure 9:
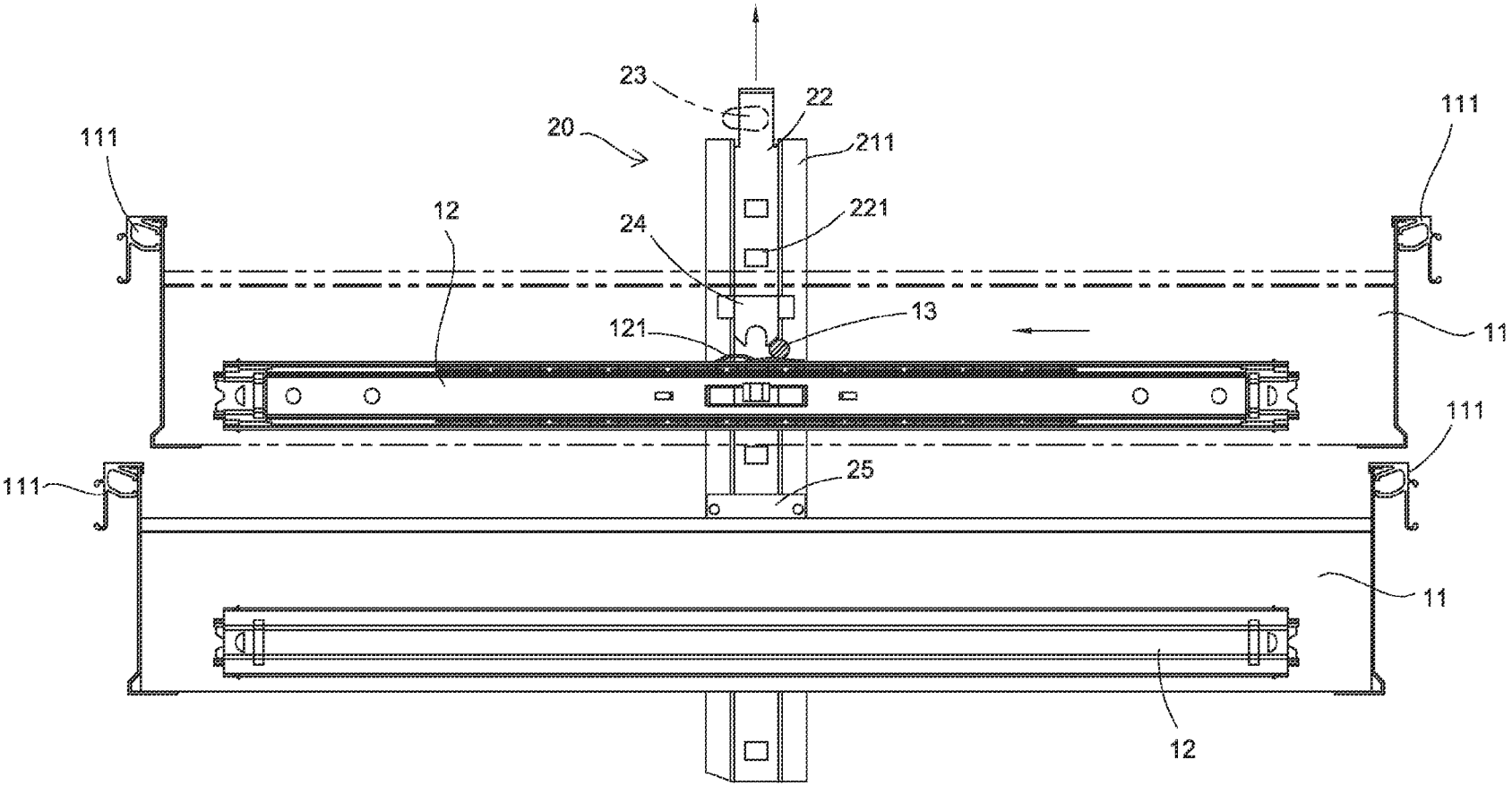
FIG. 9 is a view similar to FIG. 6 showing an operation of locking one drawer by pushing the peg into the trough along the inclined surface of the snapping member.

As shown in FIG. 9, there is one drawer 11 is not locked with the peg 13 clearing the trough 241. Next, the user may push the drawer 11 (as indicated by arrow) to ride the peg 13 along one inclined surface 242 with both the snapping member 24 and the sliding member 22 move upward. The upward movement may abruptly stop when the peg 13 is disposed directly below the trough 241. Thereafter, both the snapping member 24 and the sliding member 22 move downward immediately due no support thereunder and their weight. As a result, the drawer 11 is locked (see FIG. 7).

Figure 10:
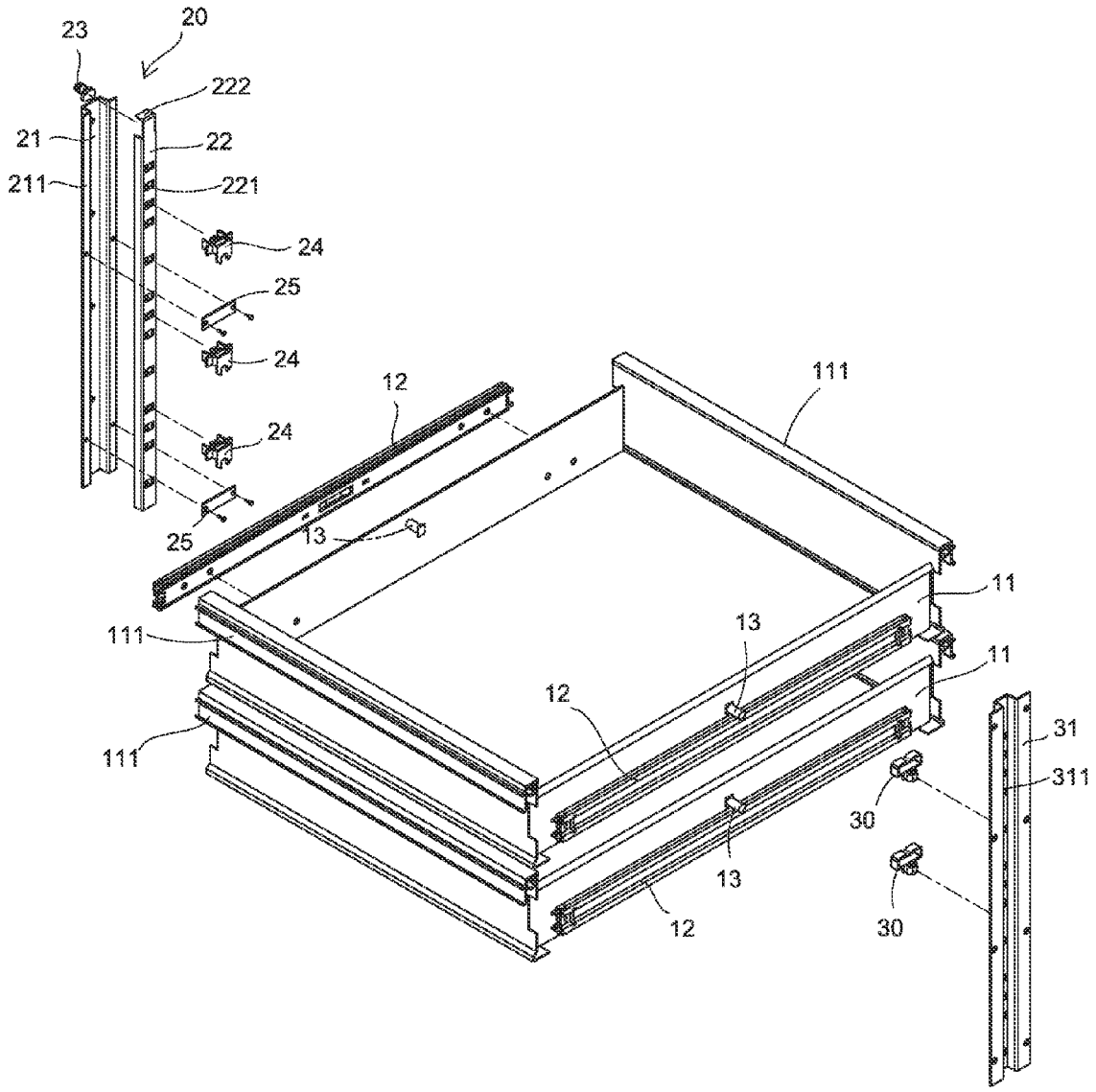
FIG. 10 is an exploded view of a lock device for two-way travel drawers of a support body (e.g., cart) according to a second preferred embodiment of the invention.
Figure 11:
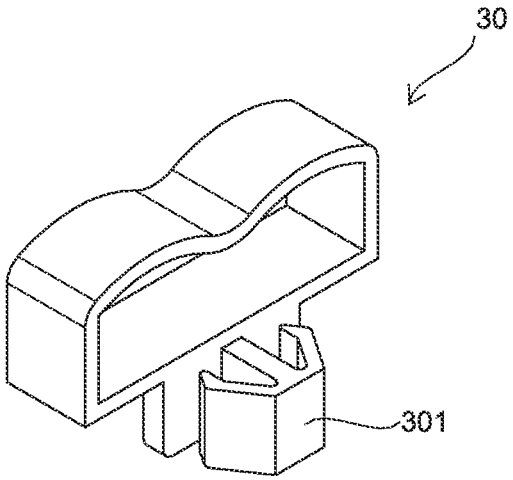
FIG. 11 is a perspective view of the positioning member of FIG. 10.

Referring to FIGS. 10 and 11, a lock device for a two-way drawer in accordance with a second preferred embodiment of the invention is shown. The characteristics of the second preferred embodiment are substantially the same as that of the first preferred embodiment except the following:

The positioning seat is eliminated from the slide at on side. A plurality of positioning members 30 each having the eliminated positioning seat are provided. The positioning member 30 further comprises a latch 301. A longitudinal trough member 31 having a plurality of rectangular openings 311 arranged longitudinally is provided at the other side of the drawer 11. Each drawer 11 comprises two slides 12 on both sides respectively and two pegs 13 disposed through the drawer sides and on central portions of tops of the slides 12 respectively. The positioning member 30 is disposed onto the opening 311. Further, the peg 13 at the other drawer side is retained on a wave shaped recessed top of the positioning member 30.

While the invention has been described in terms of preferred embodiments, those skilled in the art will recognize that the invention can be practiced with modifications within the spirit and scope of the appended claims.

What is claimed is:

1. A lock device of a plurality of two-way travel drawers of a support body, comprising in combination:

a peg disposed on a central portion of one of two sides of each two-way travel drawer;

two two-way travel slides each disposed on an outer surface of each side of each two-way travel drawer; and a lock assembly comprising a groove member, a sliding member, a lock, and a plurality of snapping members wherein the groove member has a rectangular section and includes front and rear flanges to be secured to a wall of the support body;

the sliding member has a rectangular section, is slidably disposed in the groove member, and includes a plurality of rectangular openings arranged longitudinally;

the lock is disposed on an upper portion of the wall of the support body and capable of actuating to activate the sliding member;

the snapping members are retained in the rectangular openings and capable of locking or unlocking the peg when the sliding member moves;

each respective snapping member of the snapping members comprises a latch, a trough distal the latch, two inclined surfaces on front and rear ends of the trough respectively, a first wall disposed between the latch and the trough, and two second walls with the latch disposed therebetween, and the two second walls are perpendicular to the first wall, the latch is retained in the rectangular opening, the peg is partially disposed in the trough, the first wall is slidably engaged with the flanges, and the two second walls are slidably disposed between the sliding member and the groove member.

2. A lock device of a plurality of two-way travel drawers of a support body, comprising in combination:

two pegs each disposed on a central portion of each of two sides of each two-way travel drawer respectively;

two two-way travel slides each disposed on an outer surface of each side of each two-way travel drawer;

a trough member disposed on one side of the two-way travel drawer and comprising a plurality of rectangular openings arranged longitudinally;

a plurality of positioning members each having a wave shaped top and comprising a latch retained in the rectangular opening wherein one peg is retained on the wave shaped top of the positioning member; and a lock assembly comprising a groove member, a sliding member, a lock, and a plurality of snapping members wherein the groove member has a rectangular section and includes front and rear flanges to be secured to a wall of the support body;

the sliding member has a rectangular section, is slidably disposed in the groove member, and includes a plurality of rectangular openings arranged longitudinally;

the lock is disposed on an upper portion of the wall of the support body and capable of actuating to activate the sliding member;

the snapping members are retained in the rectangular openings and capable of locking or unlocking the peg when the sliding member moves;

each respective snapping member of the snapping members comprises a latch, a trough distal the latch, two inclined surfaces on front and rear ends of the trough respectively, a first wall disposed between the latch and the trough, and two second walls with the latch disposed therebetween, and the two second walls are perpendicular to the first wall, the latch is retained in the rectangular opening, the peg is partially disposed in the trough, the first wall is slidably engaged with the flanges, and the two second walls are slidably disposed between the sliding member and the groove member.

* * * * *